United States Patent [19]

Hockham

[11] 4,293,858

[45] Oct. 6, 1981

[54] POLARIZATION AGILE MEANDER LINE ARRAY

[75] Inventor: George A. Hockham, Valencia, Calif.

[73] Assignee: International Telephone and Telegraph Corporation, New York, N.Y.

[21] Appl. No.: 97,000

[22] Filed: Nov. 23, 1979

[51] Int. Cl.[3] ..... H01Q 11/04; H01Q 15/24

[52] U.S. Cl. ..... 343/731; 343/846; 343/854

[58] Field of Search ..... 343/731, 829, 846, 756, 343/853, 854

[56] References Cited

U.S. PATENT DOCUMENTS 3,806,946 4/1974 Tiuri et al. ..... 343/731

4,021,810 5/1977 Urpo et al. ..... 343/731

*Primary Examiner*—Eli Lieberman

*Attorney, Agent, or Firm*—William T. O'Neil

[57] ABSTRACT

A polarization-agile radar array employing at least one linear array having a periodic first meander line and a second meander line which is a close-spaced, mirror image of the first such line, these lines being separately driven so that when they are fed with equal amplitude and phase, the polarization will be in a first plane and when driven in anti-phase, orthogonal polarization is achieved. The meander lines extend in the same plane which is parallel to a ground from which it is spaced. Intermediate polarization angles are achieved by intermediate phase and amplitude relationships of the drive, equal amplitude and phase quadrature exitation providing circular polarization. A series of generally parallel, conductive vanes is affixed to the ground plane to compensate for the reactance of longitudinal sections of the meander line longitudinal feeder (connecting) sections as the wave passes therethrough when its polarization is essentially parallel to those feeder lines. In opposite polarization situations, the upper surface of the corrugated ground plane itself is the operative reflection surface, the radiation coupling at and between polarization extremes thereby being substantially uniform.

10 Claims, 6 Drawing Figures

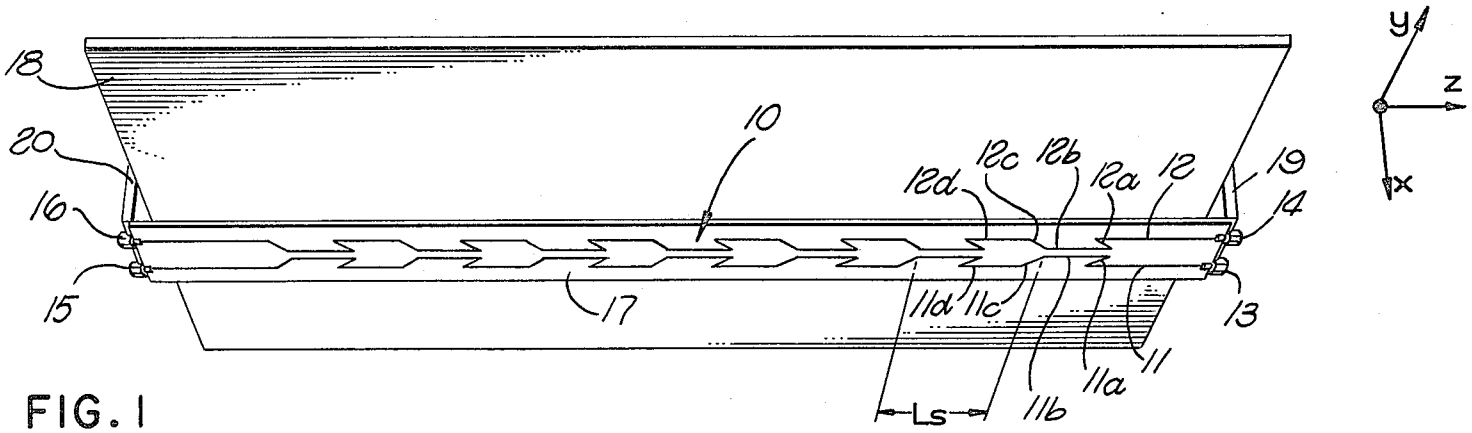
FIG. 1
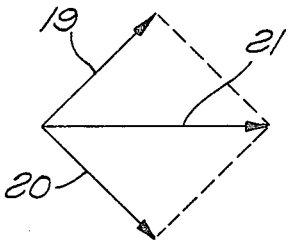
FIG. 2 IN-PHASE EXCITATION (HORIZONTAL POLARIZATION)
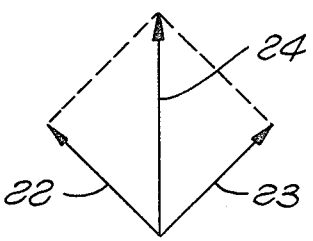
FIG. 3 180° OUT-OF-PHASE EXCITATION (VERTICAL POLARIZATION)

POLARIZATION AGILE MEANDER LINE ARRAY

BACKGROUND OF THE INVENTION

1. Field of the Invention

The invention relates generally to radar antenna systems and more particularly, to polarization agile arrays.

2. DESCRIPTION OF THE PRIOR ART

Polarization agile planar arrays are known per se in the radar art. Those prior art devices include stacked slotted waveguides with radiator slots alternately angled on opposite sides of a cross-section plane and appropriate interleaved phase control. An example of such a system is shown in U.S. Pat. No. 3,716,856 entitled "Polarization Adaptive MTI Radar Transponder".

A "Polarization Agile Planar Array" employing dielectrically loaded slotted square coaxial linear arrays in a stacked arrangement with similar interleaved phase control is described in U.S. patent application Ser. No. 861,903, filed Dec. 19, 1977, now U.S. Pat. No. 4,197,541. That application is assigned to the assignee of this application.

The slotted waveguide polarization agile array described in the aforementioned U.S. Pat. No. 3,716,856 involves a relatively expensive array of precisely manufactured waveguide sections having precisely located and dimensioned slotting. The square coaxial line array with slotting in accordance with the aforementioned U.S. patent application Ser. No. 861,903 alleviates many of the problems associated with the slotted waveguide array in that the coaxial linear arrays of which it is composed are not subject to the frequency cut-off limitations inherent in waveguide. Still further, the slotted coaxial sections are relatively easily dielectrically loaded for wave slowing, the resulting structure being considerably lighter and more efficient than the waveguide version. The radiation coupling from the square coaxial array is, however, subject to the expense of cutting slots in the square coaxial walls and although its overall manufacturing cost is substantially less than that of the waveguide device, it nevertheless is substantial.

The present invention is based on certain aspects of the so-called "meander line", and a background understanding of that device is essential to a proper understanding of the present invention. The meander line which borrows from microwave stripline and microstrip technology has been previously referred to as a "sandwich wire antenna". In the year 1957 such an antenna was described by W. Rotman and N. Karas in a paper entitled "The Sandwich Wire Antenna: A New Type of Microwave Line Source Radiator". That paper appeared in the IRE National Conference Record 1957, PT. 1, pp. 162–172. Those authors also describe such devices in an article entitled "The Sandwich Wire Antenna", appearing in the *Microwave Journal*, Vol. 2, Aug. 1959. A more recent reference appeared in the *IEEE Transactions-Antenna and Propagation*, Vol. AP 19, No. 5, Sept. 1971, under the title "A New Analysis of the Sandwich Wire Antenna".

The manner in which the present invention exploits the characteristics of the meander line in a new combination having distinct advantages over prior art arrangements for the general purpose, will be understood as this description proceeds.

SUMMARY OF THE INVENTION

It may be said to have been the general objective of the invention to provide a polarization agile antenna array system which is light in weight, low in cost and high in performance.

According to the invention, at least one linear array consisting of a first longitudinally extending meander line array and a second such array disposed in relatively close spacing and in the form of a mirror image of the first meander line. This pair of meander lines comprising one linear array would normally be duplicated by a number of such linear arrays in the same plane with their longitudinal center lines substantially parallel. These meander line linear arrays are supported in their common plane over a conductive ground plane, the direction of radiation being normal to the said ground plane or at an angle to the said normal depending upon parameters and design considerations discussed hereinafter.

The two mutually mirror imaged meander lines forming each linear array of the total planar array of a typical embodiment according to the invention, are separately fed through a controlled phase arrangement. This may comprise either a single phase shifter for one of the meander lines of the pair comprising each of the aforementioned linear arrays, or alternatively, each of these individual meander lines might be fed in parallel with a corresponding meander line in each of the other linear arrays through a first phase shifter, the remaining meander lines of each linear array being fed in parallel through a second phase shifter, these two phase shifters then being differentially controlled. That arrangement has the advantage that the range of phase shift controllability required of an individual phase shifter is only half that required if only one meander line of each pair were controlled to produce the required differential.

To obtain all possible polarization states necessitates both amplitude and phase control between lines, and accordingly, the phase shifters may be thought of as including amplitude control structure.

The details of a typical embodiment of the invention will be described hereinafter, a clearer understanding of the nature of the invention being obtainable in this subsequent description.

BREIF DESCRIPTION OF THE DRAWINGS

FIG. 1 is a pictorial view of a single linear meander line array including a pair of meander lines each of which is a mirror image of the other, mounted in a plane parallel to and spaced from a ground plane;

FIG. 2 is a vector diagram depicting the generation of horizontal polarization from in-phase exitation;

FIG. 3 is a vector diagram depicting the generation of vertical polarization from anti-phase exitation;

FIG. 4 also shows a typical phase-controlled drive for use with the array arrangement according to the invention;

DETAILED DESCRIPTION OF THE DRAWINGS

Figures 4, 5:
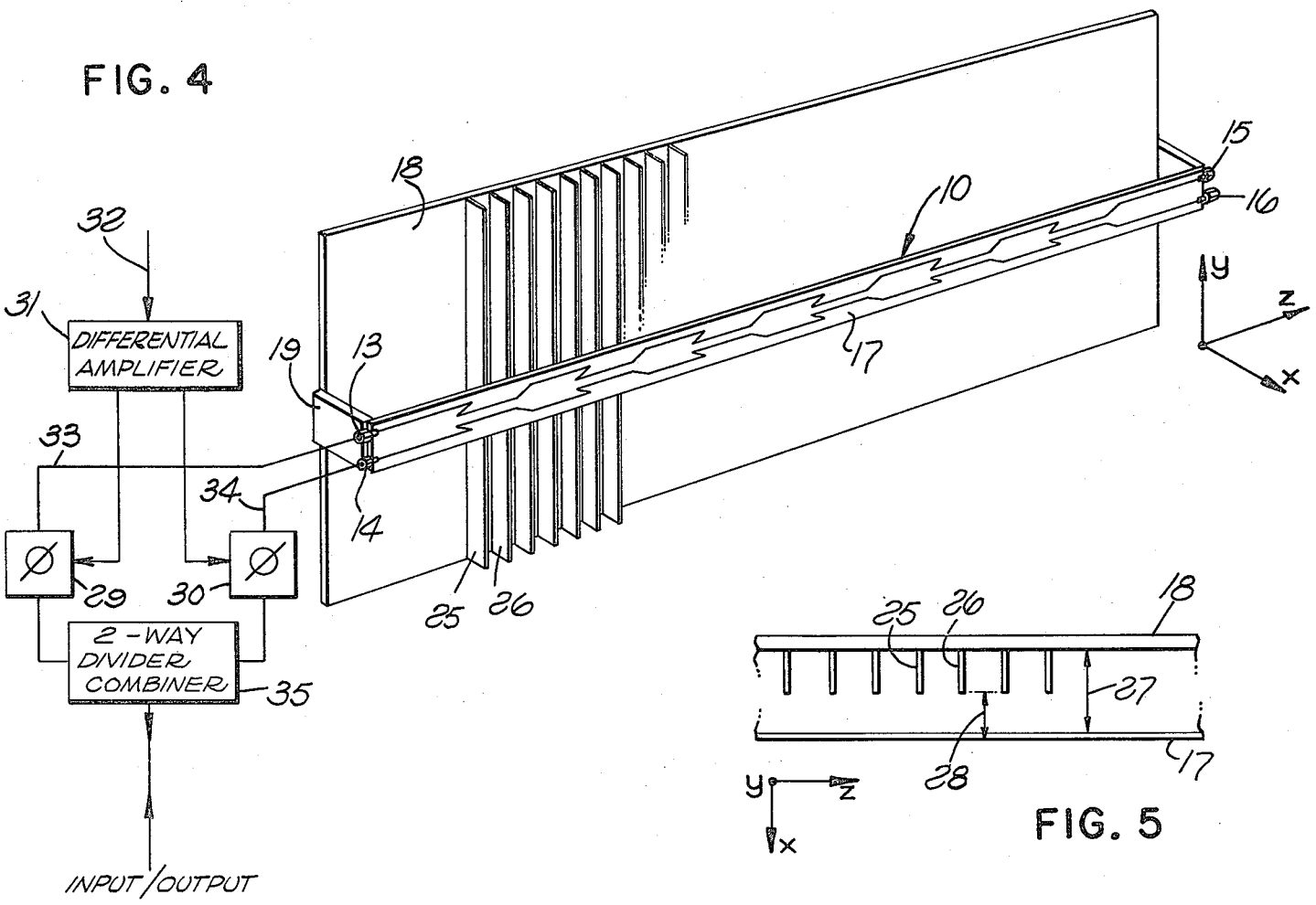
FIG. 4 is a pictorial illustrating the use of compensating vanes to equalize radiation loss over the full range of polarizations obtainable.
FIG. 5 is a top view of FIG. 4.

Referring now to FIG. 1, a simplified antenna array including a ground plane and one representative linear meander line array is depicted.

The planar surface 18, which is either solid metal or at least metal coated on its surface visible in FIG. 1, is large enough to accommodate backing of any array including a number of the linear meander line arrays typically duplicates of that depicted at 10. Such a plurality of linear arrays form a planar array entirely backed by the ground plane 18.

Each of the meander line linear arrays, such as 10, includes two meander lines, each of which is a mirror image of the other. Each of these lines is periodic and extends longitudinally in what has arbitrarily been depicted as the Z coordinate. This Z coordinate is substantially parallel to the long dimension of the ground plane 18 as depicted in FIG. 1.

The first meander line, including 11, 11*a*, 11*b*, 11*c* and 11*d*, etc., comprises a continuous printed conductor on the supporting dielectric substrate 17. That particular line is connected between input port 13 and output port 15. The other meander line of this pair printed on the supporting substrate 17 includes the sections 12, 12*a*, 12*b*, 12*c* and 12*d*, etc., the printed conductor thereof extending continuously between input port 14 and output port 16.

The dielectric supporting substrate 17 is preferably only sufficiently thick to provide adequate mechanical support for the appended meander lines, but should be of a low radio frequency loss type material, thereby having no substantial electrical effect. Such material and the techniques for depositing printed conductors thereon are well known in this art. The skilled practitioner can readily select materials and a conductor printing technique suitable for use in constructing the apparatus according to the present invention, taking into consideration environmental, mechanical and related matters of ordinary skill.

The ports 13, 14, 15 and 16 are conveniently provided with coaxial fittings, the interconnections to RF sources and other circuitry being conveniently provided in coaxial cable, (for example).

The so-called longitudinal center line of each of the individual linear meander line arrays such as 10 will be understood to be congruent with the Z coordinate center line as depicted in FIG. 1. The X coordinate, extending normal to the ground plane 18 is the nominal direction of radiation, although it will be realized as this description proceeds that the actual direction of radiation is frequency dependent. At a predetermined design-center frequency, however, the radiation of the apparatus of FIG. 1, either with or without the additional linear arrays which would form a planar array, would be along this X coordinate.

The Y coordinate is the vertical if it is assumed that the array is to be erected with the ground plane 18 in a vertical plane. In a practical system, the orientation of the ground plane 18 and therefore of the array "boresite" (normal to 18) might be elevated somewhat so that boresite is at an angle above the horizon. Those considerations refer to a ground installation, of course.

Referring again to the use of coaxial cables and fittings at the input and output ports 13 through 16, it will be realized that some form of impedance transition or matching is appropriate, since the meander line nominal impedances in a practical design run on the order of 2 to 3 times the common 50 ohm coaxial impedance. By providing a conductive ground plane tape at the input and output extremes of the meander lines, i.e., by bending (flaring) the ground plane toward the plane of the meander lines in the immediate vicinity of the inputs and outputs, an improvement in input and output matching can be achieved.

Referring now to FIG. 2, the generation of a field vector 21 corresponding to horizontal polarization is seen to be achieved by two in-phase vectors 19 and 20 applied at input ports 13 and 14, respectively. By providing antiphase exitation, i.e., 180° phase difference between inputs 13 and 14, the vector 20 from FIG. 2 may be thought of as having been reversed. In FIG. 3, the vector 23 may be assumed to be the same vector 19 of FIG. 2, but vector 20 having been reversed now becomes vector 22. The resultant field vector 24 depicts vertical polarization from the device of FIG. 1.

Referring now to FIG. 4, the apparatus of FIG. 1 is shown with a typical phase-controlled feed arrangement and with conductive vanes, typically 25 and 26. FIG. 5, which is a top view of the configuration of FIG. 4, may be considered comtemporaneously, since it further clarifies the showing of FIG. 4.

The conductive vanes typically 25 and 27 are to be understood to be distributed about the entire surface of the ground plane 18, with at least 5 such vanes per wavelength (dimension Ls), this being the minimum number of vanes required to produce a virtual ground plane surface spaced a distance 28 as shown in FIG. 5 from the meander line plane. The operation of the vanes such as 25 and 27 is such that, for horizontal polarization per FIG. 2, they are of no substantial effect. However, with vertical polarization they provide the aforementioned virtual ground plane as indicated. In the other extreme (horizontal polarization) the ground plane 18 is fully operative providing a ground plane to meander line plane spacing identified as 27 on FIG. 5. At intermediate polarizations, both the vanes and the ground plane 18 are partially operative in accordance with the component of any intermediate polarization in the vertical and horizontal planes.

In FIG. 4, a feed arrangement is also illustrated, this being also applicable to the configuration of FIG. 1. A pair of signal-controlled phase shifters 29 and 30 are differentially controlled in phase by polarization control signals extant at 32 through the differential amplifier 31. The RF inputs to phase shifters 29 and 30 are provided from a two-way divider combiner 35.

It will be realized that the apparatus of the invention is reciprocal and as such, is operable for both transmitting and receiving. There is, of course, the requirement that the phase shifters themselves be reciprocal; however, various known continuous-control RF phase shifters are available. Also, in many cases, discrete angular steps of phase selection would be acceptable. In that case, a phase shifter technique using RF diodes of the PIN type coupled with selected transmission line lengths may be used. Such a device is described in U.S. Pat. No. 4,070,639. Certain obvious modifications would be required to use that form of diode switched phase shifter, such as transition from the waveguide medium with which it is intended to operate into a coaxial transmission line medium. The modifications required are within the ordinary skill of this art, however. PIN diode controlled phase shifter are also otherwise known and as described in the technical literature.

It should be noted that the radiation coupling obtainable is a function of the length of the individual radiating strips of the meander lines. Those strips are the angled portions of the meander line such as for example 11*a*, 12*a*, 11*c* and 12*c*, as identified in FIGS. 1 and 6.

Figure 6:
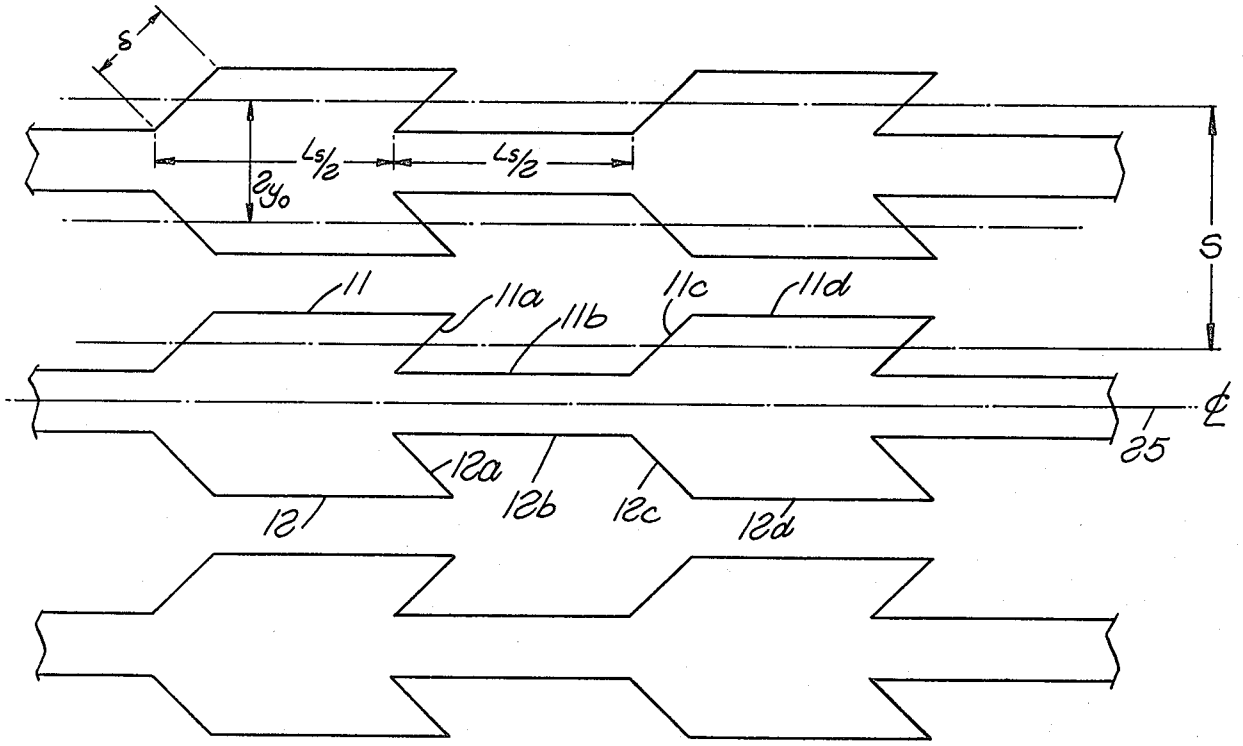
FIG. 6 is a schematic of a portion of a planar array employing the invention.

Referring now to FIG. 6, a schematic diagram of portions of a meander line planar array illustrating portions of three adjacent linear meander line arrays is depicted. For an array operating in the 3 GHz band a typical value of $L_s$ is 2.8", i.e., $L_s/2=1.4$ inches. Also, the radiating strip length $\delta$ is typically 0.25 inches and the nominal linear spacing S is 2.2 inches. Still further, a typical value for 2 $y_0$ is 0.750 inches. A typical value of spacing between the meander line plane on support substrate 17 and the ground plane 18 is 1.2 inches. This is represented as 27 in FIG. 5. The difference between 27 and 28 on FIG. 5 is, of course, the height of the vane such as 25 and 26 over the ground plane 18. A typical value for dimension 28 on FIG. 5 is 0.840 inches. An acceptable printed circuit conductor deposited on the substrate 17 is on the order of 0.05 in width and 0.025 in thickness.

In choosing the various parameters, for design purposes, optimum radiation coupling is desired for all polarizations of which the device is capable. In general, if the meander lines are spaced on the order of one-quarter wavelength at midband from the ground plane, this optimum condition is closely approached.

Since the radiating strip lengths (11*a*, 12*a*, etc.) influences radiation coupling in the same manner as slot orientation in a slotted-waveguide antenna, it will be realized that an aperture amplitude taper can be introduced by modifying the meander lines such that the radiation strips are longest at array center and are tapered (reduced in length) gradually on either side of array center. The connecting conductors such as 11*b*, 12*b*, 11*d* and 12*d* (see FIG. 1) must remain substantially parallel to the longitudinal center line of the indicidual linear meander line arrays forming the planar array of FIG. 6, however.

Although it is contemplated that the angle of the radiation strips with respect to the longitudinal center line is on the order of 45°, it may in fact be greater, although all of the radiating strips of the array should assume the same angle. Increase of this angle beyond 45° tends equalize radiation loss for the drive conditions previously described, while permitting polarization purity to be relatively uneffected as long as the symmetry is preserved.

Modifications and variations of the structure of the invention as herein described will suggest themselves to those skilled in this art once the principles of the invention are understood. Accordingly, it is not intended that the drawings or this description should be regarded as limiting the invention, these being intended to be a typical and illustrative only.

What is claimed is:

1. A polarization agile system with a meander line antenna array, comprising:

at least one periodic linear array having a first longitudinally extending meander line and a second relatively close-spaced longitudinally extending meander line, said lines being mirror images of each other and both lying in a first plane;

means within each of said meander lines comprising a plurality of longitudinally spaced radiating strips disposed in said first plane and each at the same angle with respect to the longitudinal center line of said linear array, and connecting conductors between adjacent ones of said radiating portions to provide a continuous series conductive path throughout each of said meander lines;

a conductive ground plane substantially parallel to said first plane and spaced therefrom by a first spacing;

and radio frequency feed means for end feeding said meander lines in a predetermined phase relationship to provide a corresponding plane of polarization for said array.

2. A system in accordance with claim 1 in which said angle of said radiating strips is substantially 45° with respect to said longitudinal center line and said connecting conductors are all substantially parallel to each other and parallel to said longitudinal center line.

3. A system according to claim 1 including a dielectric mounting strip, said radiating strips and connecting conductors being printed circuit leads deposited on said mounting strip.

4. A system according to claim 2 including a dielectric mounting strip, said radiating strips and connecting conductors being printed circuit leads deposited on said mounting strip.

5. A system according to claim 1 in which said array comprises a plurality of said periodic, linear arrays substantially uniformly spaced laterally in said first plane, said ground plane extending at least over the full area opposite said plural linear arrays in said first plane, and said feed means being arranged to feed the meander lines of each of said arrays in the same manner as said one linear array.

6. A system according to claim 4 in which said array comprises a plurality of said periodic, linear arrays spaced substantially uniformly spaced laterally in said first plane, said ground plane extending at least over the full area opposite said plural linear arrays in said first plane, and said feed means being arranged to feed the meander lines of each of said arrays in the same manner as said one linear array.

7. A system according to claim 5 in which said feed means comprises at least one signal controlled phase shifter connected in the feed path to a corresponding one of said meander lines of each of said linear arrays whereby a control signal applied to said phase shifter determines the differential phase shift between said meander lines of each of said linear arrays to produce a predetermined polarization of said array.

8. A polarization agile system with a meander line antenna array, comprising:

at least one periodic linear array having a first longitudinally extending meander line and a second relatively close-spaced longitudinally extending meander line, said lines being mirror images of each other and both lying in a first plane;

means within each of said meander lines comprising a plurality of longitudinally spaced radiating strips disposed in said first plane and each at the same angle with respect to the longitudinal center line of said linear array, and connecting conductors between adjacent ones of said radiating portions to provide a continuous series conductive path throughout each of said meander lines;

a conductive ground plane substantially parallel to said first plane and spaced therefrom by a first spacing;

means comprising a plurality of spaced, conductive vanes normal to and in contact with said ground plane and extending toward said first plane, the planes in which said vanes lie being also perpendicular to said linear array longitudinal center line, said vanes providing an auxillary ground plane operating to tend to equalize radiation loss as a function of polarization of said array;

and radio frequency feed means for end feeding said meander lines in a predetermined phase relationships to provide a corresponding plane of polarization for said array.

9. A system according to claim 8 in which said array comprises a plurality of said periodic, linear arrays spaced substantially uniformly spaced laterally in said first plane, said ground plane extending at least over the full area opposite said plural linear arrays in said first plane, and said feed means being arranged to feed the meander lines of each of said arrays in the same manner as said one linear array.

10. A system according to claim 8 in which said feed means comprises at least one signal controlled phase shifter connected in the feed path to a corresponding one of said meander lines of each of said linear arrays whereby a control signal applied to said phase shifter determines the differential phase shift between said meander lines of each of said linear arrays to produce a predetermined polarization of said array.

* * * * *